US005365623A

United States Patent [19]

Springer

[11] Patent Number: 5,365,623

[45] Date of Patent: Nov. 22, 1994

[54] TELEPHONE HOLDER FOR BED SIDE RAIL

[76] Inventor: Maurice D. Springer, 1509 Yoder Rd., Fort Wayne, Ind. 46819

[21] Appl. No.: 113,278

[22] Filed: Aug. 27, 1993

[51] Int. Cl.[5] ..... A47C 21/00

[52] U.S. Cl. ..... 5/658; 5/503.1; 5/507.1; 248/309.1; 248/447.2; 248/207; 379/454

[58] Field of Search ..... 5/503.1, 507.1, 658; 248/214, 207, 205.2, 309.1, 447.2; 379/454

[56] References Cited

U.S. PATENT DOCUMENTS

| | | | |
|---|---|---|---|
| 3,009,676 | 11/1961 | Buchwald . | |
| 3,400,829 | 9/1968 | Youngson | 5/507.1 X |
| 3,480,741 | 11/1969 | Wiggins . | |
| 3,802,657 | 4/1974 | Jackson . | |
| 4,431,154 | 2/1984 | Hamm . | |
| 4,432,522 | 2/1984 | Pruente et al. . | |
| 4,484,317 | 11/1984 | Jenkins | 5/503.1 X |
| 4,504,992 | 3/1985 | Herron et al. . | |
| 4,602,755 | 7/1986 | Roster | 5/658 X |
| 4,819,266 | 4/1989 | Awakowicz et al. . | |
| 4,945,581 | 7/1990 | Rioux, Jr. | 248/214 X |
| 4,998,277 | 3/1991 | Rioux, Jr. . | |
| 5,222,132 | 6/1993 | Rioux, Jr. | 248/214 X |
| 5,282,599 | 2/1994 | Arpaia et al. | 5/503.1 X |
| 5,295,649 | 3/1994 | Lee | 248/205.2 |
| 5,316,249 | 5/1994 | Anderson | 248/205.2 X |

*Primary Examiner*—Michael F. Trettel
*Attorney, Agent, or Firm*—George Pappas

[57] ABSTRACT

An apparatus for detachably attaching to a bed side rail and supporting a telephone thereon. The apparatus includes V-shaped slots for slipping over and receiving the side rail horizontal bar and a spring clamp therebelow adapted for detachable attachment to a side rail vertical bar. The telephone support surface can be horizontal or at an angle from the vertical. The telephone is detachably attached to the apparatus. In another embodiment, the apparatus includes slots adapted to receive and frictionally engage the side rail horizontal bar.

21 Claims, 2 Drawing Sheets

TELEPHONE HOLDER FOR BED SIDE RAIL

TECHNICAL FIELD

The present invention relates to the technical field of telephone supporting apparatus. More specifically, the present invention relates to a support apparatus which is detachably attachable to a bed side rail for supporting a telephone thereon.

BACKGROUND OF THE INVENTION

In recent years, our society is more widely using telephones and the availability and use of a telephone has become not only convenient but almost a necessity. In view of this need, hospitals now provide substantially all bed-ridden patients with a bed side telephone. Most often, the telephone is placed on a bed side stand adjacent to the bed. However, locating the telephone on the bed side stand is inconvenient. Depending on the condition of the patient and other hospital equipment around the bed, it can be very difficult for the patient to reach to the top of the bed side stand for accessing the telephone.

As a result of the above-described inconvenience, some patients place the telephone directly on the bed on one side thereof on top of the bed covers. As can be appreciated, this is also inconvenient and restrictive in not allowing the patient use of the entire bed. Additionally, inadvertent pulling of the bed covers, such as when the patient is asleep, causes the telephone to tip or otherwise roll and causing the handset to be inadvertently disjoined from the telephone.

Solutions to the foregoing problems have been to provide hospital bed telephone brackets or holders which are attached to a bed side rail and which function to support the telephone thereon. Examples of such bed side rail telephone holders are disclosed in Jackson, U.S. Pat. No. 3,802,657; Hamm, U.S. Pat. No. 4,431,154; Pruente et al., U.S. Pat. No. 4,432,522; Herron et al., U.S. Pat. No. 4,504,992; and, Rioux, Jr., U.S. Pat. No. 4,998,277. Although these telephone brackets and holders function to support a telephone on a bed side rail, they have shortcomings and drawbacks. In general, these prior telephone brackets and holders are capable of only holding a telephone on a bed side rail and must be stored when not in use in a separate location from that of the telephone. Thus, when the telephone is on the bed side stand, the bracket must be stored elsewhere. Additionally, the prior telephone brackets and holders do not necessarily provide a positive attachment between the holder or bracket and the bed side rail and also do not provide a positive attachment between the telephone and the bracket or holder. Therefore, it is possible for the bracket or holder to be dislodged from the side rail or for the telephone to be dislodged from the bracket or holder itself.

Accordingly, a need exists for a bed side rail telephone holder/bracket that positively attaches to the bed side rail and that also provides a positive attachment between the holder/bracket and the telephone supported thereon. Additionally, a need exists for eliminating the storage problem of the holder/bracket when it is not attached to the bed side rail. Further yet, the holder/bracket must be generally sturdy and attractive to consumers yet must be generally inexpensive to manufacture.

SUMMARY OF THE INVENTION

It is the principal object of the present invention to overcome the above-discussed disadvantages associated with prior bed side rail telephone holders and brackets.

The present invention overcomes the disadvantages associated with prior bed side rail telephone brackets and holders by providing an apparatus that detachably attaches to the bed side rail and which is capable of supporting a telephone both when attached to the bed side rail and when not attached and, for example, placed on the bed side table. For positive attachment to the bed side rail, the apparatus includes a pair of side walls each of which have a slot adapted for selectively receiving the horizontal bar of the bed side rail. A support wall extends between the side walls and is adapted for supporting the telephone thereon. Below the side wall slots a spring clamp is provided for detachably attaching to the vertical bar of the bed side rail. Thus, by placing the side wall slots onto the side rail horizontal bar and, thereafter, causing the spring clamp to be attached to the vertical bar of the bed side rail, a generally positive attachment is provided between the apparatus and the bed side rail.

Preferably, so as to provide a more positive attachment, the side wall slots are generally V-shaped thereby wedgingly receiving the bed side rail horizontal bar and, further, for accommodating different size of horizontal bars. Each of the side walls also include a flat edge adapted for supporting the telephone on a flat horizontal surface when detached from the bed side rail. The telephone support wall can be horizontally disposed or at an angle with respect to the vertical so as to accommodate different types of telephones and so as to place the telephone at a convenient angle.

A positive attachment is also provided between the apparatus and the telephone. In the preferred embodiment, the telephone is detachably attached to the support wall with a fastening material such as Velcro®. This fastening material includes a first patch affixed to the support wall and a second patch affixed to the telephone. One of the patches includes a pile material and the other includes hook material such that the pile and hook material are detachably attachable to one another.

In another embodiment, the apparatus does not include a spring clamp but, rather, is provided with side walls that each include a slot slightly smaller in cross-section than the bed side rail horizontal bar and which are, thus, adapted to receive and frictionally engage the horizontal bar. The support wall, again, extends between the side walls for supporting the telephone thereon and complimentary fastening material is provided between the support wall and telephone for positively detachably attaching the telephone thereon. This embodiment is preferred when the bed side rail horizontal bar is generally elliptic in cross section such that the side wall slots are elongate and conform to the horizontal bar cross section shape. Thus, the frictional engagement therebetween prevents inadvertent radial movement of the apparatus around the horizontal bar.

In one form thereof, the present invention is directed to an apparatus for detachably attaching to a bed side rail and supporting a telephone. The bed side rail includes a horizontal bar and a vertical bar. The apparatus includes a pair of side walls, each side wall having a slot adapted for selectively receiving the horizontal bar. A support wall is provided and extends between the side walls for supporting a telephone thereon. A mechanism is provided vertically below the side wall slots for contacting the bed side rail vertical bar in a manner whereby the apparatus is detachably attached to the bed side rail by placing the horizontal bar in the slots and the mechanism in contact with the vertical bar below the horizontal bar.

In one form thereof, the present invention is directed to an apparatus for detachably attaching to a bed side rail and supporting a telephone. The bed side rail includes a horizontal bar. The apparatus includes a pair of side walls each having a slot slightly smaller than a cross section of the horizontal bar and adapted to receive and frictionally engage the horizontal bar. A support wall extends between the side walls for supporting a telephone thereon. Complimentary fastening material is provided between the support wall and a telephone for detachably attaching the telephone to the support wall.

BRIEF DESCRIPTION OF THE DRAWINGS

The above-mentioned and other features of and objects of this invention and the manner of obtaining them will become more apparent and the invention itself will be better understood by reference to the following description of embodiments of the invention taken in conjunction with the accompanying drawings wherein.

Corresponding reference characters indicate corresponding parts throughout the several views of the drawings.

The exemplifications set out herein illustrate preferred embodiments of the invention in one form thereof and such exemplifications are not to be construed as limiting the scope of the disclosure or the scope of the invention in any manner.

DETAILED DESCRIPTION OF SPECIFIC EMBODIMENTS

Figure 1:
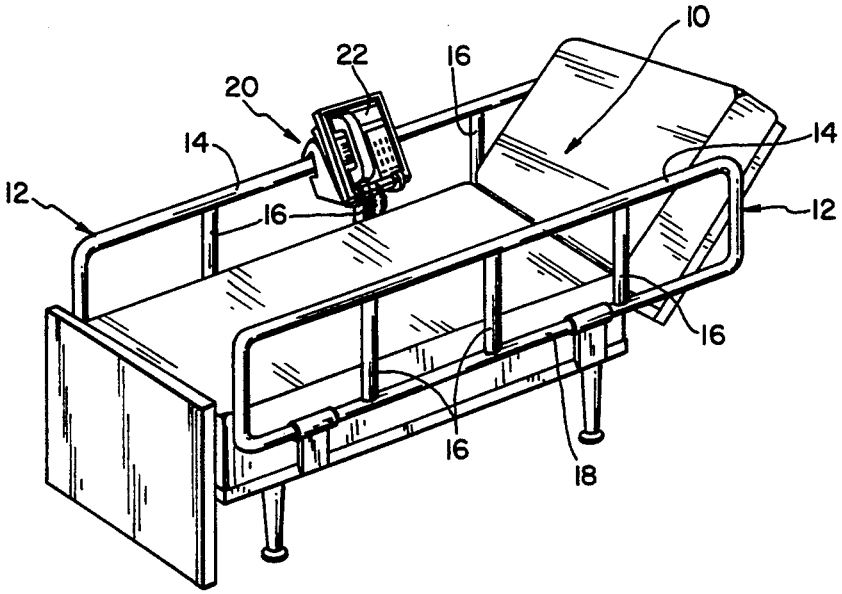
FIG. 1 is a perspective view of a hospital bed with bed side rails and whereupon an apparatus according to the present invention is detachably attached for supporting a telephone.

Referring initially to FIG. 1, there is shown a hospital bed 10 having side rails 12. Side rails 12 are selectively movable vertically up and down so as to be in the position shown to prevent the patient from falling off of bed 10 or in a retracted position (not shown) for allowing the patient to easily get on and off the bed. Side rails 12 include an upper horizontal bar 14, a plurality of vertical bars 16 and a lower horizontal bar 18.

An apparatus generally designated by the numeral 20 is shown, according to the present invention, for detachably attaching to bed side rail 12 and supporting a telephone 22 thereon. Telephone 22 includes a handset 24 adapted for resting on telephone 22 and being electrically connected thereto via a flexible telephone cord 26.

Apparatus 20 includes side walls 28 attached to one another with a pair of elongate members 30 extending between and attached to the side walls 28 with screws, adhesive or other suitable fastening means (not shown). It is noted that the upper surface 34 of elongate members 30 and edges 32 of side walls 28 in this preferred embodiment form a support wall for supporting the telephone 22 thereon.

Figure 2:
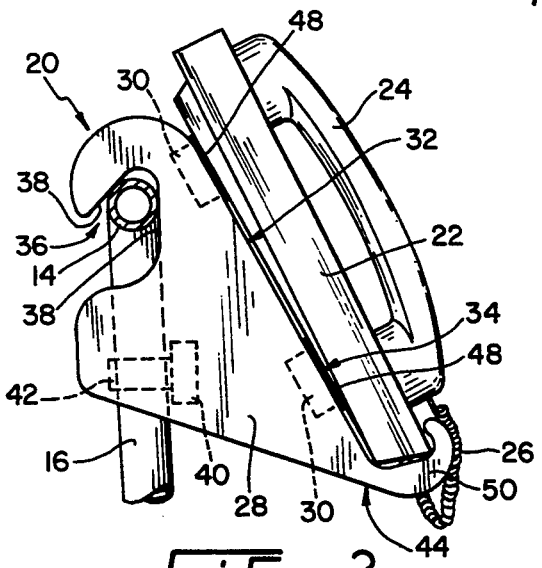
FIG. 2 is a side elevational view of the apparatus shown in FIG. 1 according to the present invention.

V-shaped slots generally designated by the numeral 36 are formed or cut into each of side walls 28 and are adapted for selectively receiving the horizontal bar 14 of side rails 12. V-shaped slots 36 include edges 38 for contacting upper horizontal bar 14. As can be appreciated, the V-shaped slots 36 provide a means by which the horizontal bar 14 can be wedgingly received therein as shown in FIG. 2 for a more positive attachment. Additionally, the V-shaped slots 36 provide versatility in receiving different size of horizontal bars 14.

A horizontal bracket member 40 also extends between side walls 28 and is attached to side walls 28 by screws, adhesive or other suitable fastening means (not shown). Horizontal member 40 is provided for supporting side walls 28 and, additionally, for attaching thereto a mechanism for contacting a bed side rail vertical bar 16. Preferably, as shown in the drawings, a spring clamp 42 is attached to horizontal bracket member 40 and is detachably attachable to vertical bar 16. Accordingly, apparatus 20 can be positively attached to side rail 12 by first placing the side rail horizontal bar 14 within slots 36 and, thereafter, pushing spring clamp 42 onto vertical bar 16 for detachably attachment thereto as shown in FIG. 2.

Each of side walls 28 further include a flat support edge 44 which together form a flat surface. In this fashion, when apparatus 20 is detached from bed side rail 12, it can be placed on a flat horizontal surface such as a table whereat the apparatus 20 may continue supporting telephone 22. Thus, there is no need to store apparatus 20 when not in use. Rather, apparatus 20, when detached from the bed side rail 12, is merely moved to a table or other horizontal flat surface and used thereat.

Apparatus 20 further advantageously provides a positive attachment between telephone 22 and apparatus 20 so as to prevent inadvertent dislodging and to prevent telephone 22 from falling from apparatus 20. In this regard, the preferred embodiment includes complimentary fastening means between the apparatus telephone support wall and the telephone 22 for detachably attaching the telephone to the support wall of apparatus 20. More preferably, the fastening means includes first patches 46 affixed to upper surface 34 of elongate members 30 and second patches 48 affixed to the telephone. First patches 46 include hook material whereas second patches 48 include pile material (not shown) in a manner whereby the pile and hook material are detachably attachable to one another. The hook and pile material or patches 46 and 48 are commonly known as Velcro ®. This complimentary fastening means allows for detachably attaching telephone 22 to the support wall of apparatus 20 and effectively prevents telephone 22 from inadvertently falling off of apparatus 20.

Figure 3:
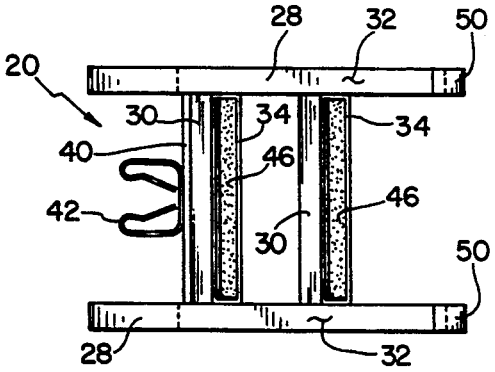
FIG. 3 is a top plan view of the apparatus shown in FIG. 2 according to the present invention.

In the embodiment shown in FIGS. 1–3, the support wall formed by surfaces 34 and edges 32 is preferably at an angle of 15 to 45 degrees from the vertical or from the side rail vertical bars 16. In this fashion, a telephone 22 of the style depicted in those figures is best accommodated. In this regard, so as to further aid the support of that style of telephone, in the embodiment shown in FIGS. 1–3, side walls 28 further include support fingers 50 extending away from the support wall and around the lower portion of telephone 22. In this manner, because the support wall is at an angle with respect to the horizontal, fingers 50 aid in retaining telephone 22 on the support wall and in a position as shown in FIGS. 1 and 2.

Figure 4:
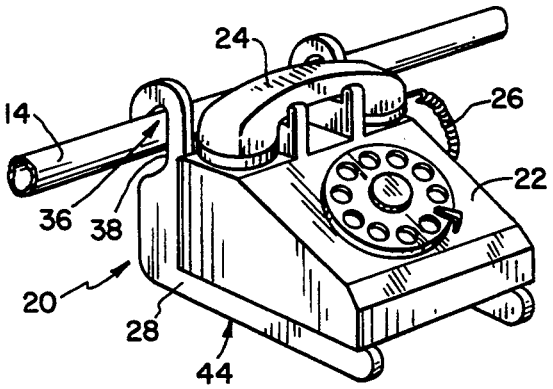
FIG. 4 is a perspective view of an apparatus according to the present invention and incorporating a support wall which is generally horizontally disposed.
Figure 5:
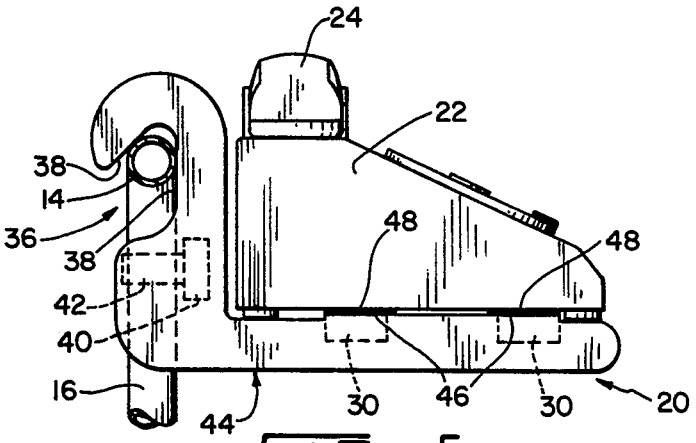
FIG. 5 is a side elevational view of the apparatus shown in FIG. 4 according to the present invention.
Figure 6:
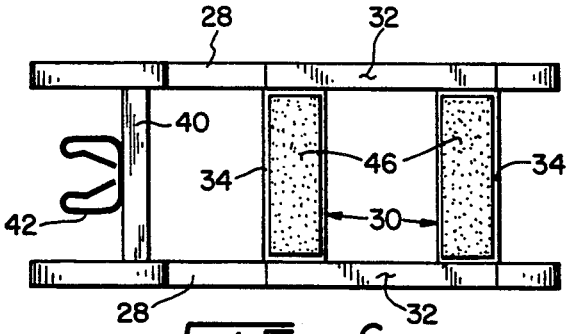
FIG. 6 is a top plan view of the apparatus shown in FIG. 5 according to the present invention.

In the embodiment shown in FIGS. 4–6, the support wall formed by edges 32 and surfaces 34 is generally horizontally disposed. In this fashion, a telephone style as shown in FIGS. 4 and 5 can better be accommodated. Nevertheless, all of the attributes and benefits provided in the embodiment shown in FIGS. 1–3 are also provided by this embodiment. Substantially the only difference between this embodiment and that of FIGS. 1–3 is that the sidewalls 28 are somewhat differently shaped so that the support wall supporting telephone 22 is horizontally disposed. Furthermore, fingers 50 are not provided in the embodiment of FIGS. 4–6 since they are not needed to prevent telephone 22 from slipping downwardly.

Figure 7:
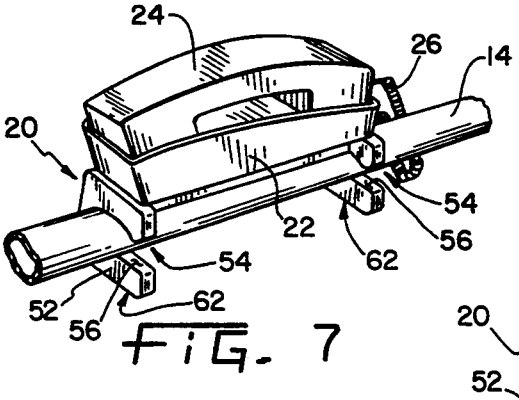
FIG. 7 is a perspective view of yet another embodiment of an apparatus according to the present invention shown detachably attached to a bed side rail horizontal bar and supporting a telephone thereon.
Figure 8:
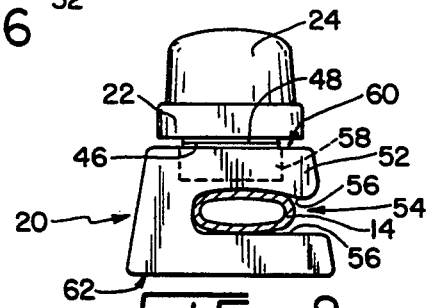
FIG. 8 is a side elevational view of the apparatus shown in FIG. 7 according to the present invention; and, FIG. 9 is a front elevational view of the apparatus shown in FIG. 7 according to the present invention.
Figure 9:
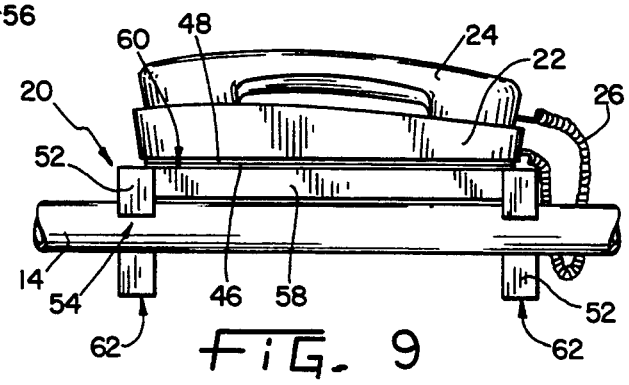

In the embodiment shown in FIGS. 7–9, the apparatus 20 is adapted for detachably attaching only to a bed side rail horizontal bar member 14. In this embodiment, a pair of side walls 52 each generally having a shape of a "C" and incorporating a slot 54 are provided. Slots 54 include an edge 56 adapted to frictionally engage horizontal bar 14. It is noted that slots 54 are slightly smaller in cross section than horizontal bar 14 such that a positive frictional engagement can be provided. Additionally, side walls 52 are made of a somewhat flexible material such as polyethylene or reprocessed high density polyethylene for expanding and slipping over horizontal bar 14 and for providing said frictional engagement.

A support wall 58 extends between side walls 52 and is attached to each of side walls 52 by screws, adhesive, or other suitable fastening means (not shown). The upper surface 60 of support wall 58 provides a surface whereupon telephone 22 may be supported. As with the embodiments shown in FIGS. 1–6, complimentary fastening means are provided between support wall 58 and telephone 22 for detachably attaching telephone 22 to the support wall 58. In the preferred embodiment, hook and pile patches 46, 48 are affixed to the telephone and to the support wall as depicted in the drawings and in a manner where the pile and hook materials are detachably attachable to one another so that the telephone may be detachably attached to the support wall 58.

The embodiment shown in FIGS. 7–9 is preferably used in situations where the side rail horizontal bar 14 is elliptic in cross section as shown in FIG. 8. In this regard, the side wall slots 54 are preferably made elongate as shown to conform to the horizontal bar elliptic cross section shape and so that apparatus 20 can support telephone 22 without potential inadvertent turning about the longitudinal axis of horizontal bar 14.

Like the embodiments of FIGS. 1–6, the apparatus of FIGS. 7–9 will also support the telephone 22 on a flat horizontal surface such as a table when detached from the side rail 12. In this regard, side walls 52 each include a lower flat edge 62 which together form a flat plane adapted to engage a horizontal surface and support telephone 22 thereon when detached from the bed side rail 12.

It is noted that in all the above embodiments, the preferred material for making or forming apparatus 20 is a plastic: such as polyethylene or reprocessed high density polyethylene. Additionally, the various parts of apparatus 20 such as side walls 28, elongate members 30, horizontal bracket member 40, support wall 58 and side walls 52 can be formed separately for assembly or integrally together by molding or injection molding. As can be appreciated, injection molding these various parts together would decrease costs of manufacturing and such construction is contemplated as part of the present invention.

While the invention has been described as having specific embodiments, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. An apparatus for detachably attaching to a bed side rail and supporting a telephone, the bed side rail including a horizontal bar and a vertical bar, said apparatus comprising:

a pair of side walls, each side wall having a slot adapted for selectively receiving the horizontal bar;

a support wall extending between said side walls for supporting a telephone thereon; and, means vertically below said side wall slots for contacting the bed side rail vertical bar, whereby said apparatus is detachably attached to the bed side rail by placing the horizontal bar in said slots and said means in contact with the vertical bar below the horizontal bar.

2. The apparatus of claim 1 wherein said side wall slots are generally V-shaped for wedgingly receiving different size horizontal bars.

3. The apparatus of claim 1 wherein said support wall is generally horizontally disposed.

4. The apparatus of claim 1 wherein said support wall is at an angle of 15 to 45 degrees from the side rail vertical bar.

5. The apparatus of claim 1 wherein said means further comprises a spring clamp adapted for detachable attachment to the vertical bar.

6. The apparatus of claim 5 wherein said spring clamp is attached to a horizontal member extending between and attached to said pair of side walls.

7. The apparatus of claim 6 wherein said side wall slots are generally V-shaped for wedgingly receiving different size horizontal bars.

8. The apparatus of claim 1 wherein said means is on a horizontal member extending between and attached to said pair of side walls.

9. The apparatus of claim 1 further comprising complementary fastening means between said support wall and a telephone for detachably attaching the telephone to said support wall.

10. The apparatus of claim 9 wherein said complementary fastening means includes a first patch affixed to said support wall and a second patch affixed to the telephone, one of said patches including pile material and the other including hook material, whereby said pile and hook materials are detachably attachable to one another.

11. The apparatus of claim 10 wherein said support wall includes a pair of elongate members, each extending between and attached to said side walls, said first patch affixed to one of said elongate members.

12. The apparatus of claim 9 wherein said support wall is generally horizontally disposed.

13. The apparatus of claim 9 wherein said support wall is at an angle of 15 to 45 degrees from the side rail vertical bars.

14. The apparatus of claim 9 wherein said side wall slots are generally V-shaped for wedgingly receiving different size horizontal bars.

15. The apparatus of claim 9 wherein said means further comprises a spring clamp adapted for detachable attachment to the vertical bar.

16. The apparatus of claim 15 wherein said side wall slots are generally V-shaped for wedgingly receiving different size horizontal bars.

17. The apparatus of claim 1 wherein each of said side walls include a flat edge for supporting a telephone on a flat horizontal surface when detached from the bed side rail.

18. An apparatus for detachably attaching to a bed side rail and supporting a telephone, the bed side rail including a horizontal bar, said apparatus comprising:

a pair of side walls each having a slot slightly smaller than a cross section of the horizontal bar and adapted to receive and frictionally engage said horizontal bar;

a support wall extending between said side walls for supporting a telephone thereon; and, complementary fastening means between said support wall and a telephone for detachably attaching the telephone to said support wall.

19. The apparatus of claim 18 wherein said complementary fastening means includes a first patch affixed to said support wall and a second patch affixed to the telephone, one of said patches including pile material and the other including hook material whereby said pile and hook materials are detachably attachable to one another.

20. The apparatus of claim 18 wherein the horizontal bar is elliptic in cross sectional and said side wall slots are elongate and conform to the horizontal bar cross section shape.

21. The apparatus of claim 18 wherein each of said side walls include a flat edge for supporting a telephone on a flat horizontal surface when detached from the bed side rail.

* * * * *